United States Patent [19]

Kümmerlin

[11] 4,421,206

[45] Dec. 20, 1983

[54] LADDER

[76] Inventor: Walter Kümmerlin, Bietigheim-Bissingen, In den Fressäckern 6, Fed. Rep. of Germany

[21] Appl. No.: 228,833

[22] Filed: Jan. 27, 1981

[30] Foreign Application Priority Data

| | | | |
|---|---|---|---|
| Feb. 2, 1980 | [DE] | Fed. Rep. of Germany | 3003854 |
| May 21, 1980 | [DE] | Fed. Rep. of Germany | 3019345 |
| Sep. 24, 1980 | [DE] | Fed. Rep. of Germany | 3035955 |

[51] Int. Cl.[3] ..... E06C 1/16

[52] U.S. Cl. ..... 182/156; 182/1; 182/106; 182/116; 182/129

[58] Field of Search ..... 182/156, 159, 160, 161, 182/162, 1, 194, 165, 175, 106, 129, 116

[56] References Cited

U.S. PATENT DOCUMENTS

| | | | |
|---|---|---|---|
| 104,569 | 6/1870 | Floyd | 182/156 |
| 276,339 | 4/1883 | Beisner | 182/161 |
| 1,153,558 | 9/1915 | Matheny | 182/156 |
| 1,633,902 | 6/1927 | Olson | 182/161 |
| 2,245,825 | 6/1941 | Ross | 182/156 |
| 2,596,521 | 5/1952 | Bell | 182/156 |

FOREIGN PATENT DOCUMENTS

| | | | |
|---|---|---|---|
| 454605 | 5/1913 | France | 182/161 |
| 614373 | 9/1926 | France | 182/161 |
| 330282 | 10/1935 | Italy | 182/156 |
| 21304 | of 1891 | United Kingdom | 182/156 |

*Primary Examiner*—Reinaldo P. Machado
*Attorney, Agent, or Firm*—Martin A. Farber

[57] ABSTRACT

In a stepladder, with two legs which are connected with each other swingably around an axis in the region of an upper end of the legs, at least one of the legs has transverse support members which are supported by a first pair of stiles, and arranged spaced apart from each other in the longitudinal direction of the first pair of stiles to form the treads, said transverse support members being developed as board-shaped threads which, when the legs are spread apart a predetermined maximum distance, the standing surface of the transverse support members is horizontal and lies in horizontal planes, the treads being connected swingably about axes parallel to each other, to the first pair of stiles and to respective link members which are parallel to the first pair of stiles whereby a mutual supporting relationship between the first pair of stiles and the link members upon a predetermined maximum spread of the legs so as to increase the resistance to bending of the first pair of stiles and limit the swingability of the treads around their axis in a first direction of swing, the treads projecting beyond one side edge of the first pair of stiles facing away from the other leg such that stepping upon the treads causes a moment of rotation in a second direction which brings the link members toward the first pair of stiles.

15 Claims, 13 Drawing Figures

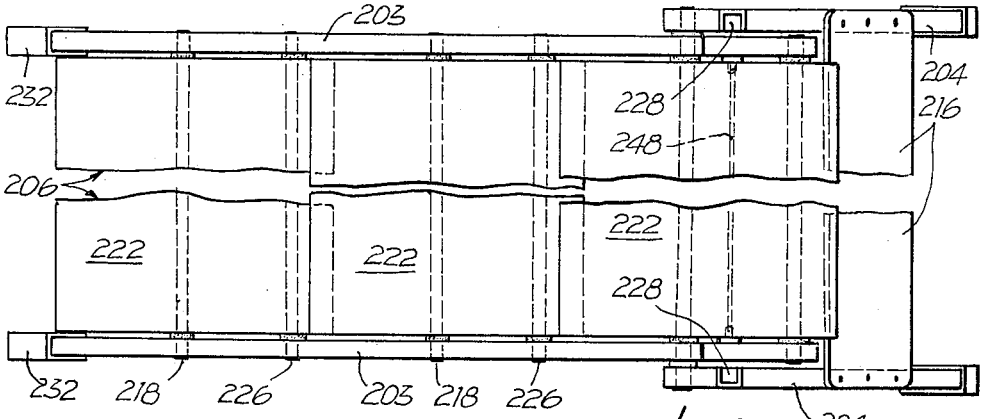
Fig.3.
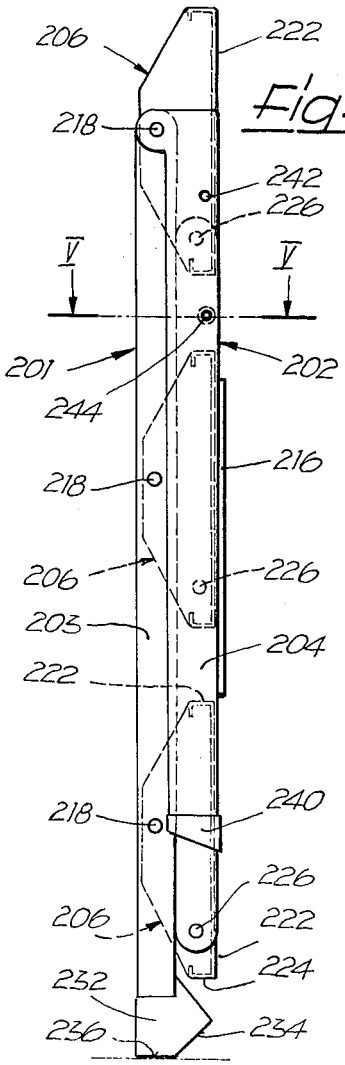
Fig.4.
Fig.5.
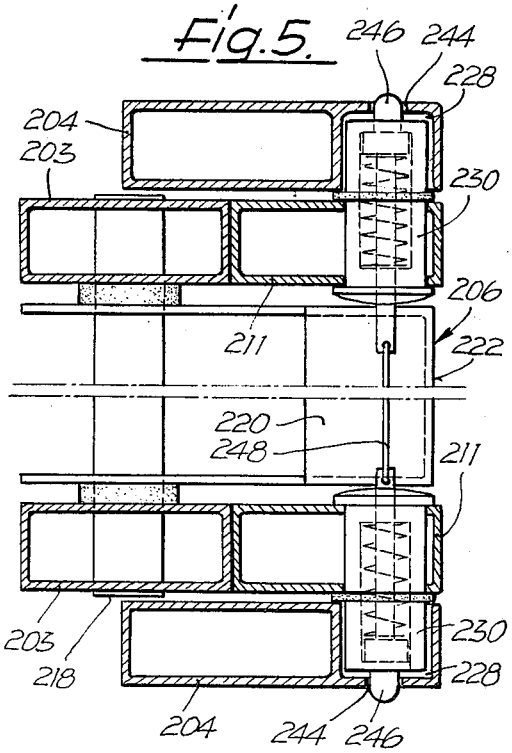

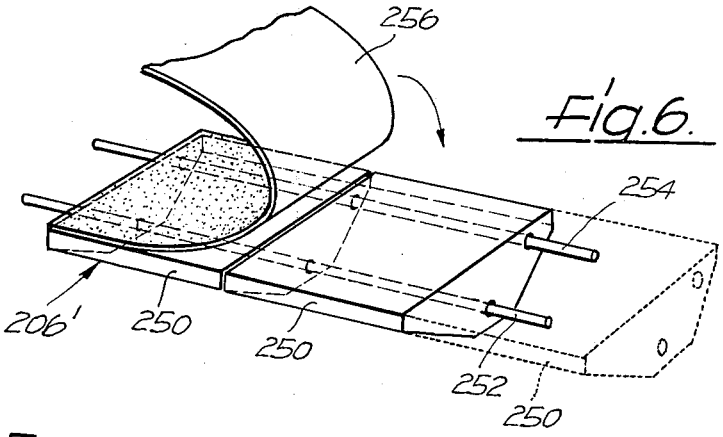
Fig.6.
Fig.7.
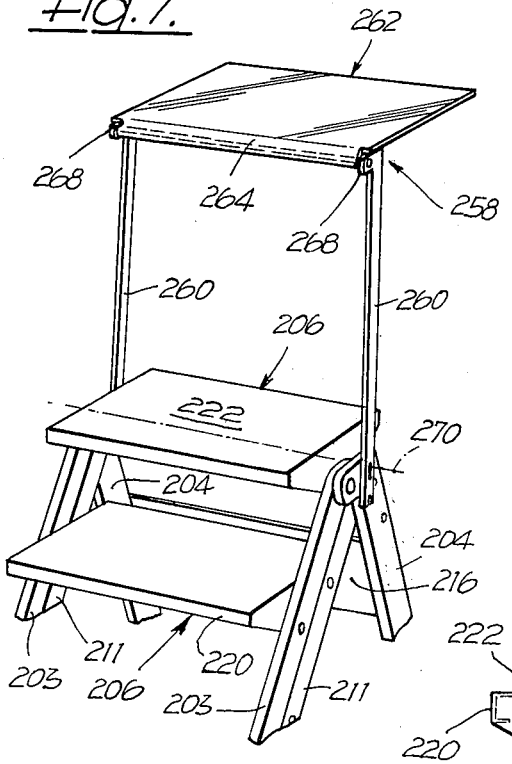
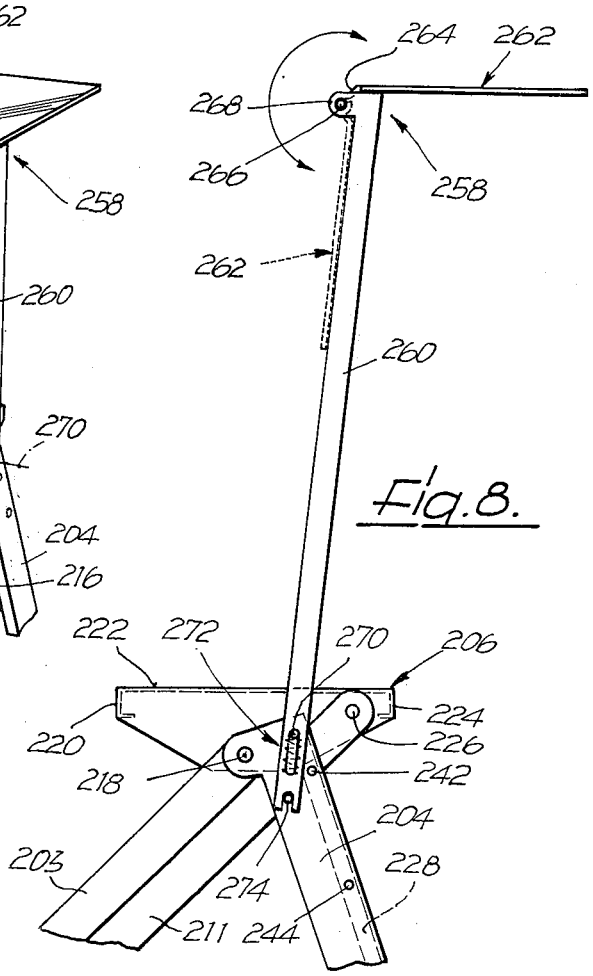
Fig.8.

531
506
530
501
506
521
515
504
511
502
506
503
505
530

LADDER

The present invention relates to a ladder in the form of a stepladder the two legs of which are swingably connected with each other around an axis so as to be able to swing the legs from the spread position of use of the ladder into a position in which they lie parallel to each other so that the ladder takes up as little room as possible for transportation and storage.

In the known stepladders of this type it is possible only with difficulty if at all to climb up or down the ladder without holding fast to the ladder itself or to some other object. Furthermore, the steadiness of the ladder and of the user on the ladder are frequently insufficient. Further disadvantages of known stepladders consist in the fact that the space which they take up in collapsed condition is greater than is absolutely necessary and that their construction is expensive.

A first object of the present invention is a stepladder which can be ascended and descended in the same way as ordinary stationary stairs, just as safely and conveniently and without having to hold onto anything.

Another object of the invention is a stepladder which not only can be ascended safely and conveniently but also has a high degree of steadiness and thus assures the steadiness of the user.

Another object of the invention is a stepladder which takes up a minimum amount of space when collapsed. Another object of the invention is a stepladder which is of the simplest possible construction and the lowest possible weight.

Still another object of the invention is a stepladder which, despite the possibility of swinging its legs and despite the use of all its parts to take up the stresses occurring upon use, excludes the risk of the fingers of the user being pinched between two parts of the ladder which are movable relative to each other upon the divergence or convergence of the legs. With the above and other objects and advantages in view, the present invention will become more clearly understood in connection with the detailed description of preferred embodiments, when considered with the accompanying drawings, of which:

FIG. 3 is a top view of the first embodiment shown in position of use;

FIG. 4 is a side view of the first embodiment shown in collapsed condition;

FIG. 5 is a horizontal section along the line V—V of FIG. 4 through the first embodiment, in vertically arranged collapsed position;

FIG. 6 is a perspective view of a modified tread;

FIG. 7 is a perspective view, partially broken away, of the first embodiment shown in position of use with additionally provided tray and holder for the tray;

FIG. 8 is a side view of the embodiment, shown in FIG. 7;

Figure 1:
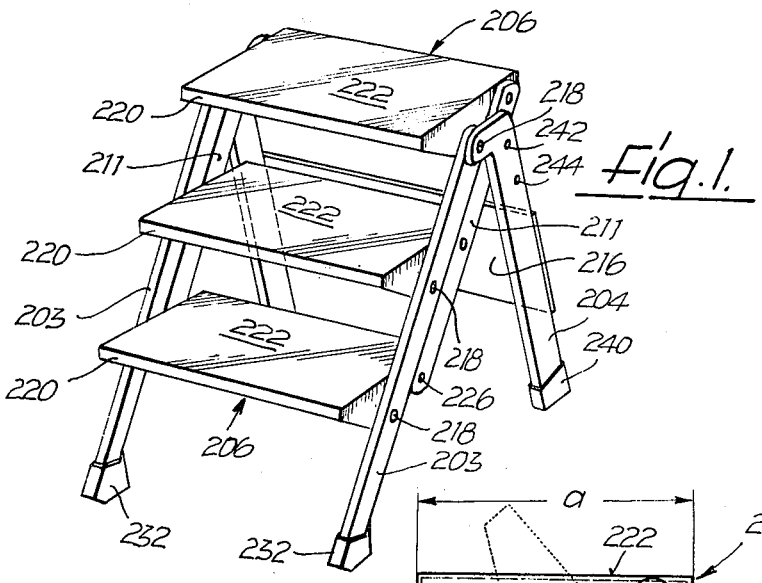
FIG. 1 is a perspective view of a first embodiment, shown in position of use.

The first embodiment, shown in FIGS. 1 to 5, is a stepladder having two legs 201 and 202 each consisting of two parallel stiles or side supports 203 and 204 respectively. The one leg 201 is provided with three treads 206 and two parallel link members 211. The other leg 202 has no treads and is provided with a stiffening board 216 instead of a cross member, it connecting the two stiles 204 rigidly together.

The treads 206, which are identical to each other, extend horizontally from stile 203 to stile 203 and are supported for turning at the points 218 of the stiles 203 around an axis which lies horizontally in the central plane M of their tread width a. As a result, the front edges 220 of the treads 206, when the legs 201 are arranged obliquely and the treads 202 horizontally, extend out of the space formed by the two maximally spread legs 201 and 202 to in front of the two stiles 203 of the leg 201. The rear edges 224 of the treads which when the treads 206 are in horizontal position extend into said space are pivotally mounted at the places 226 of the two link members 211 so that each tread is swingable, with simultaneous rotation around its two pivots 218 around its two pivots 226, which can move on circular arcs around the pivot points 218. Therefore on both sides of the ladder there is a parallelogram mechanism which is formed of the rear halves of the treads 206 of one stile 203 and a co-planar parallel link member 211. The arrangement is such that, with the legs 201 and 202 spread a maximum distance apart so that the treads 222 are horizontal, each link member 211 rests against the stile 203 associated with it, the pivot points 226 which are fixed to the link but travel, lying higher than the pivot points 218 secured to the stile.

By the resting of the link members 211 against the stiles 203 in the maximum spread position, the link members increase the resistance to bending of the stiles 203, which increases the load-carrying capacity and steadiness of the ladder. The stiles can therefore be made weaker and thus of lower weight and hence more compact than if there were no mutual support between the stiles 203 and the link members 211. The pressure of application is increased by the weight of the body acting on one or two treads, which assures good steadiness. Furthermore in this way assurance is had that the maximum spread which is desirable for reasons of steadiness, is obtained in a positive manner. The protrusion of the treads beyond the front side of the stiles also has the advantage that the lower ends of the stiles are no longer disturbingly evident and do not form stumble points, which is also of importance for the safety of the person using the ladder.

Figure 2:
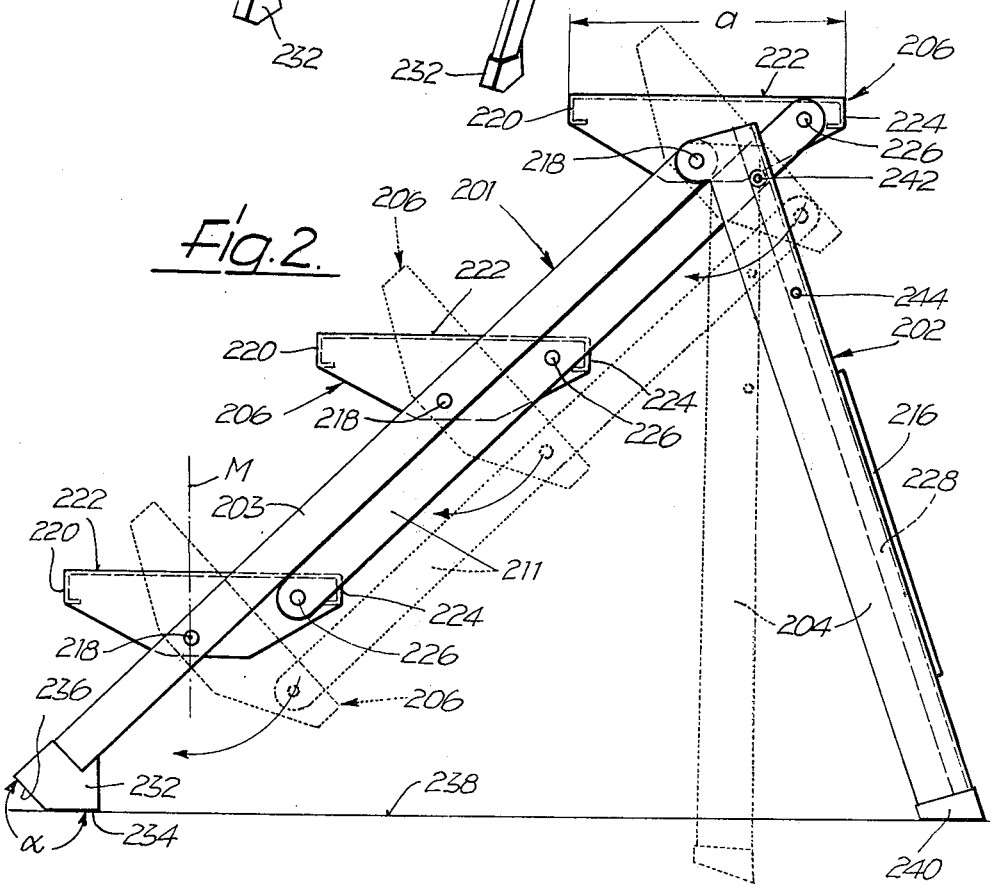
FIG. 2 is a side view of the first embodiment shown in position of use.

The difference in height between two successive trends 206, the depth or tread width a and the inclination of the stiles 203 upon maximum spreading of the legs 201 and 202 are so selected that the ladder can always be used in convenient and safe manner in the same way as a fixed staircase, particulrly as the treads 206 overlap only very slightly, as shown in FIG. 2. The inclination preferred with stationary stairs, which is equal to the quotient of the difference in height divided by the width of tread is between about 0.44 and 0.77.

The legs 201 and 202 are pivoted together at the two uppermost pivots 218, the rear leg being shorter and thus serving as support for the front leg. Each stile 204 of the rear leg 202 is a hollow profiled bar having a groove 208 of a slot-pin guide, the groove being open towards the other rear stile 204, with a hollow pin 230 which protrudes laterally outward from the associated link member 211 and engages into the ontinuous groove 228 which extends parallel to the rear stile 204. For this purpose the two link members 211 lie between the two rear stiles 204 whose lateral distance apart is greater than the lateral spacing of the front stiles 203, each of whose lower ends bears a shoe 232 which has two resting surfaces 234 and 236 which form with each other a reflex external angle $\alpha$, by means of which surfaces the longer one leg 201 rests on the ground 238 upon the maximum spreading of the two legs, or the entire ladder rests on the ground when the legs 201 and 202 are closed. On the other hand a hoof-like shoe 240 is sufficient on each of the shorter rear stiles 204.

In order to lock the hollow pins 230 in the grooves 228 when the two arms 201 and 202 are maximally spread apart and in their closed position respectively, each groove 228 is provided in its bottom with a borehole 242 located at the top and a lower borehole 244, into which boreholes a locking bolt 246 optionally engages, the bolt being supported for longitudinal displacement in one of the hollow pins 230 and being under spring pressure, the bolt being capable of being withdrawn for unlocking from the occupied borehole by means of a pull rope 248 common to both bolts. The relative dimensions of the ladder parts are so selected that, upon the spreading of the legs 201 and 202 of the collapsed stepladder, the link members 211, which are guided on the rear leg 202, swing the treads 206 until they are horizontal when the link members strike against the front stiles 203 and the legs are spread to the maximum amount, and that, conversely, upon the collapsing of the maximally spread legs the link members 211 are moved back and the treads 206 swung back. Furthermore, the link members 211 also rest against the front stiles 203 when the ladder is collapsed, the treads 222 then lying in one plane. The ladder takes up minimum space in this position.

The tread shown in FIG. 6 is a modification of the treads 206. This modified embodiment, which can be provided instead of the treads 206 in the ladder shown in FIGS. 1 to 5, consists, as shown, of two or more identical tread parts 250 which are so placed onto two horizontal parallel round rung bars 252 and 254 that there is no space between them. The lower rung bars 252 are supported on the front stiles at the place where the places 218 are in the first embodiment. Accordingly, the higher rung bars 254 are supported on the link members at the place where the places 226 are in the first embodiment.

All tread parts 250 of the same tread are covered with a continuous rubber matting 256.

FIGS. 7 and 8 show the supplementing of the first embodiment by means of a tray bracket 258.

The tray bracket 258 consists essentially of two straight parallel extension arms 260 and of a planar rectangular, flat and therefore plate-shaped tray 262 whose front edge 264 is rolled in on itself and receives a swivel shaft 266 each of the ends of which is supported on a respective extension arm 260. For this purpose, each of the two extension arms 260 has a strap 268 protruding at a right angle, which straps flank the front edge 264 on the tray on its two ends. Outside of its front edge 264 the tray 262 extends in direction parallel to the edge beyond the two edge ends by an amount which is equal at least to the thickness of the straps 268. The protruding distance serves as stop for the tray 262 on the extension arm 260.

The two extension arms 260 are pivoted at maximum distance from each other to the upper ends of the rear leg stiles 204 so that they can be swung jointly around a horizontal axis. In an approximately vertical end position directed upward as shown in FIG. 8, the tray bracket 258 can be locked in the manner that the pivoted ends, not bearing the tray 262, of the two extension arms 260 can, due to to their fork-shaped development and two turn and push joints 272 having the common shaft 270, each be brought into engagement with a locking bolt 274 which is arranged protruding laterally outwards on the upper end of each rear stile 203. In this end position of the tray bracket 258 its tray 262 can be swung through a reflex angle around the axis 266 between a horizontal ready position shown in solid lines in FIG. 8 and an approximately vertical lowered position shown in dashed lines in FIG. 8. Both in the ready position and in the lowered position the side edges of the tray 262 lie against the tray-supporting free ends, of the extension arms 260 outside of the straps 268.

The other end position of the tray bracket 258 in which it is directed downward, which position is assumed before and after use and is reached after the swinging of the tray bracket down towards the rear, is determined by the coming of the edge 264 of the tray 262 in its lowered position against the two rear stiles 203. In both end positions of the tray bracket 258, the tray 262 cannot by itself leave its lowered position since it is held in this position by its own weight against the two extension arms The two legs 301 and 302 of the second embodiment of a stepladder shown in FIGS. 9 to 11 have stiles 303 and 304 respectively and are swingably connected with each other in the region of the upper end of the stiles. The stiles 304 are connected to each other by a board-like cross member 305 at a distance from their lower ends which form the standing surface, so that the leg 302 has sufficient steadiness.

Figure 9:
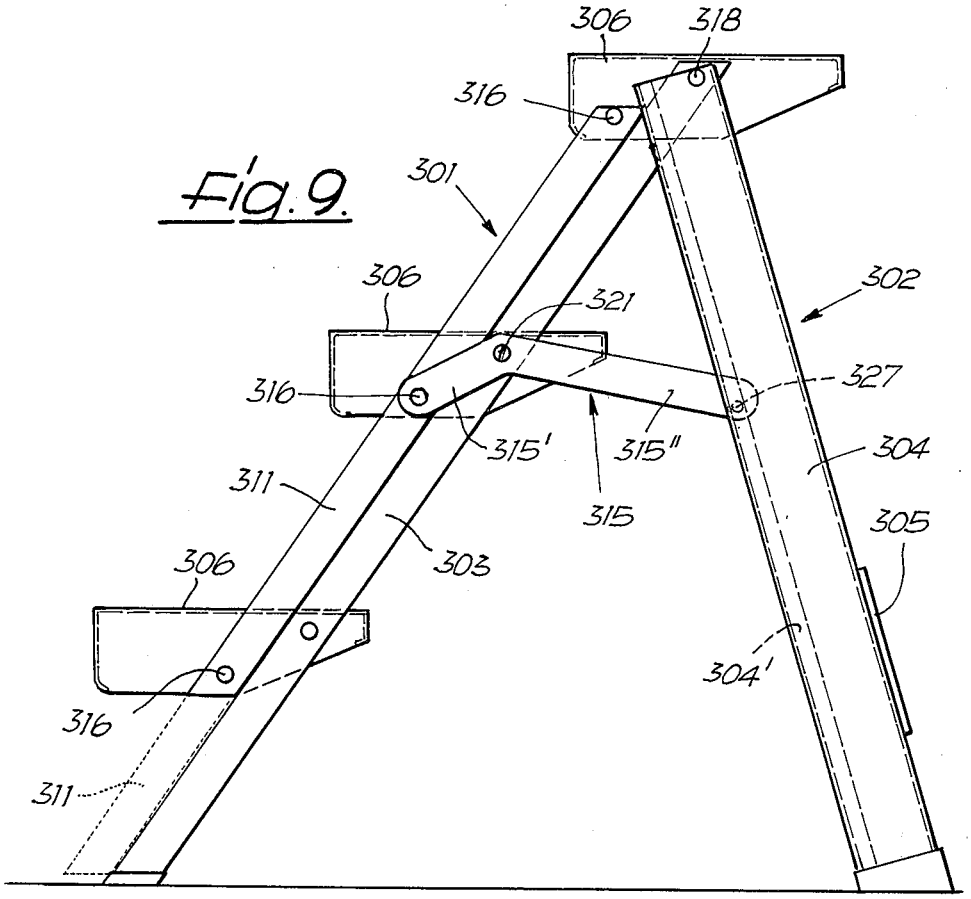
FIG. 9 is a side view of a second embodiment, shown in position of use.

Between the stiles 303 whose upper ends engage between the stiles 304, there are arranged, spaced equally apart in the longitudinal direction of the legs, treads 306 which, as shown in FIG. 9, extend from one stile to the other of the leg 301.

The treads 306, all of which are of the same shape, are made of a metal sheet, namely from an aluminum sheet for reasons of weight. The sheet is flanged downward on all four sides of the rectangular tread surface, thereby obtaining not only high rigidity and stability of the steps even when using a relatively thin sheet, but also a support cheek on each of the two sides.

As shown in FIG. 9, the uppermost tread is supported approximately in the center between its front and rear edges on the axle 318 which connects the two legs with each other. In the embodiment shown this axle is formed of a continuous rod. However, two journal pins aligned with each other could also be provided. The other two treads 306 are swingably supported, like the uppermost tread, in the leg 301. Their pivot points, however, are staggered to different extents towards the rear edge of the tread as compared with the support point of the uppermost tread so that the inclination of the step formed by the treads 306 is less than the inclination of the leg 301 when the two legs are spread the maximum distance apart. This maximum angle of spread, as well as the difference in height between two successive steps and the d epth of step, are so selected that in the position of use there is obtained a position of the tread such as is customary in staircases. By the downwardly increasing protrusion towards the front of the tread 306 beyond the stiles 303, the result is furthermore obtained that the lower end of these stiles protrudes insignificantly, if at all, beyond the lowermost tread. Furthermore, the smaller projection of the uppermost tread as compared with the other treads reduces the length of the ladder in collapsed condition.

Figure 10:
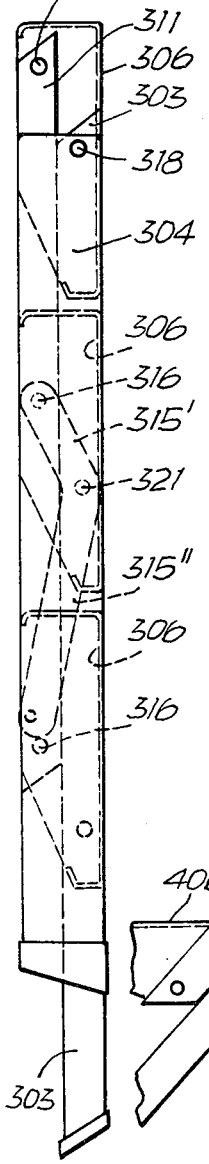
FIG. 10 is a side view of the second embodiment, shown in the transportation position.

In order to hold the treads 306 in a horizontal position with maximum spread of the two legs 301 and 302 and horizontal standing surface and swing them jointly into this position upon the spreading of the legs and bring them into the position shown in FIG. 10 upon the collapsing of the ladder, in which position their treads lie in a common plane which lies parallel to the plane defined by the rear of the stiles 304 or within said plane but does not protrude towards the rear beyond it, two link members 311 are provided. The treads 306 are swingably connected in the region of their support cheeks to these link members 311, which are arranged in front of the one and the other stile 303 and in their plane of swing as shown in FIG. 9. The pivot points 316 are in this connection so selected within the region of the bearing cheeks that each link member 311, upon maximum spread of the legs 301, 302, rests against the front side of the stile 303 towards which it is directed and in this connection holds the tread of the steps 306 in a horizontal position when the ladder stands on a horizontal surface. By this resting of the link members 311 against the stiles 303, the load-carrying capacity and steadiness of the leg 301 is increased. The stiles 303 and the link members 311 can therefore be relatively thin-walled aluminum shapes. This is true also of the stiles 304, whose width is so selected that, as shown in FIG. 10, when the ladder is collapsed the stiles 303 and the link members 311, which lie against them also in this position, as well as the treads 306 protrude neither forward nor rearward.

Figure 11:
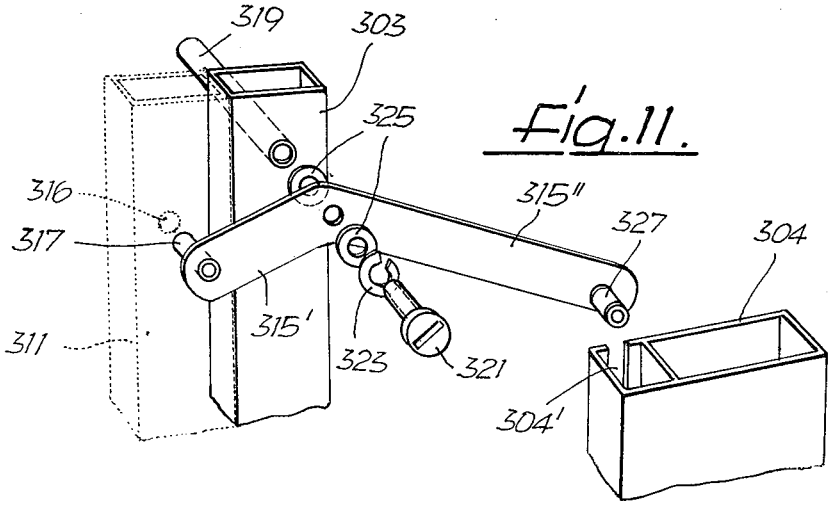
FIG. 11 is an exploded view of the swing lever of the second embodiment, as well as portions of the parts connected to it.

The link members 311 need to extend only from the top to bottom treads 306. However, for aesthetic reasons, they can also extend to the lower end of the stiles 303, as indicated by dashed lines in FIG. 9. In this connection, to be sure, it should be pointed out that the stiles 303 and not the link members 311 form the standing surface. In order to swing the treads 306 relative to the stiles 303 upon the spreading of the legs 301, 302 or the collapsing of the ladder around the axis 318 or the swivel axes of the middle and lowermost treads lying parallel to it, so that in the position of use and the position of non-use they assume the position shown in FIGS. 9 and 10 respectively, a swing lever 315 is provided on each side of the ladder. These two swing levers 315 also serve to limit in form-locked fashion the spreadability of the two legs 301 and 302 to the maximum angle of spread. The swing levers 311, as shown in FIGS. 9 and 10, are double-armed levers the two arms 315' and 315" of different length of which form an obtuse angle which is open downwards in the position of use of the ladder. The leg 301 lies between the one and the other shorter arm 315' and the two longer arms 315" engage between the stiles 304 of the leg 302. In order that no further pivot points for a swingable connection of the shorter arm 315 to the stile 303 and the link member 311 are necessary, the two swing levers 315 are supported, in the illustrative embodiment, on the swivel axle which connects the central tread 306 to the stiles 303 and, for the pivoting of the free end of its shorter arm 315' to the link member, the pin 317 which connects the ladder to the tread is provided. This pin 317, as shown in FIG. 11, is connected at its one end firmly to the link member 315. In assembled condition it passes through aligned boreholes of the link member and the bearing cheek of the central step.

In order to be able to select the moment of rotation which must be applied in order to swing the two legs 301 and 302 relative to each other, as is advisable in order to prevent the ladder from unintentionally collapsing, the moment of friction between the two swing levers 315 and the stiles 303 is adjustable. For this purpose the swivel axis of the central tread 306 is developed as a continuous bar 319 which is firmly connected at its two ends to the stiles 303 and has at each end a central blindhole with internal thread. Into this internal thread there is screwed a screw 321 which forms the pivot pin for the swing lever 315, on which screw, as shown in FIG. 11, there is provided a spring washer 323 resting against the screw head and two washers 325 one on one side and the other on the other side of the swing lever 315. By greater or lesser tightening of the screw 321 the desired moment of friction can be established between the swing lever 315 and the stile 303.

At the end of the longer arm 315" of each of the two swing levers 315 there is supported, in overhung manner a travel roller 327 which protrudes outward from the swing lever and engages into an inwardly open guide groove 304' of the hollow profile bar of which the stiles 304 of the leg 302 are formed. Upon the opening and closing of the ladder the travel rollers 327 move in the guide grooves 304' which extend in the longitudinal direction of the stiles 304. However, it is not necessary to limit the displaceability of the travel rollers in the longitudinal direction of the groove in order to limit the angle of spread of the legs since the two swing levers cannot carry out any further swinging motion relative to the stiles 303 when the link members 311 rest against them. The angle of spread of the legs can therefore not be increased beyond the value shown in FIG. 9 since a further swinging movement of the swing lever 315 in counter-clockwise direction around the axis defined by the screw 321 would be necessary for this.

Figure 12:
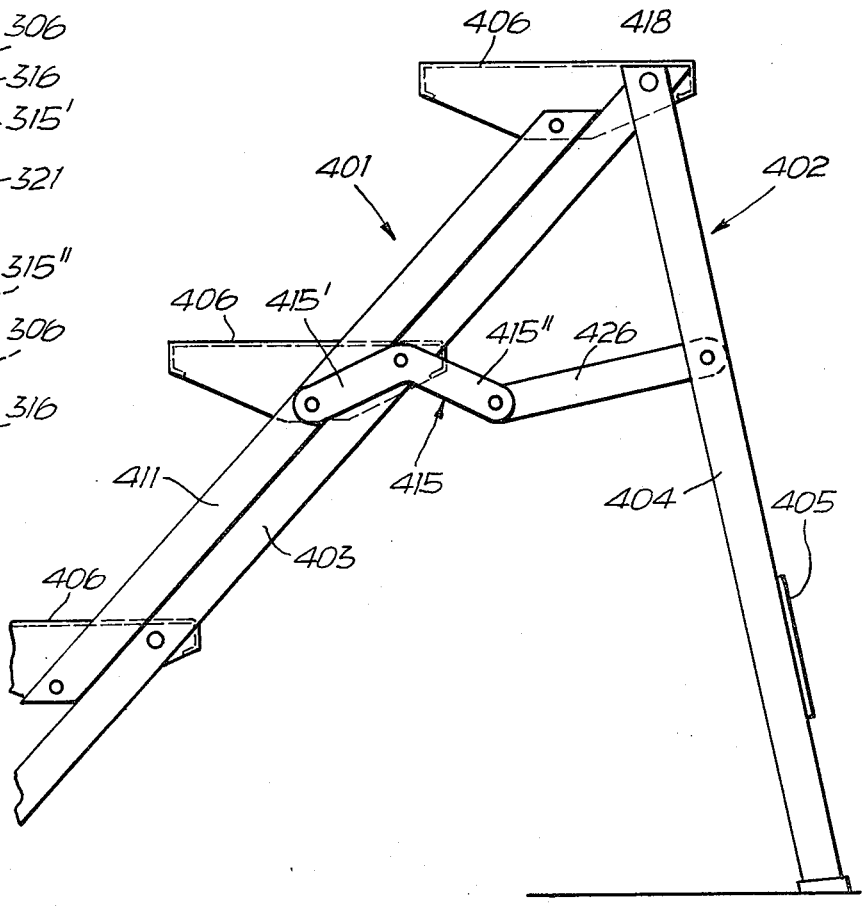
FIG. 12 is a side view of a third embodiment, shown in position of use.

The third embodiment, shown in FIG. 12, agrees in its essential features with the second embodiment as shown by a comparison with FIG. 9. Corresponding parts have therefore been designated by reference numbers which are higher by a value of one hundred and the following explanation is limited to the distinguishing features. With respect to the other features, reference is had to the explanation given of the second embodiment.

The identically shaped treads 406 are all connected with the stiles 404 of the leg 401 as well as the link members 411 in such a manner that in the position of use of the ladder they have the same projection beyond the link member 411. To be sure, the staggered arrangement shown in FIG. 9 could also be used, in the same way as, on the other hand, the treads 306 of the second embodiment could all project by an equal amount beyond the link members 311. Since, for the swingable connection of the treads 406 to the stiles 403 there are provided separate bar-shaped or tubular shafts which extend from one stile to the other and of which the one which bears the uppermost tread also forms the pivot shaft 418 of the stepladder, it is sufficient to connect the treads 406 to the two link members 411 and each of the latter to a separate one of the two swing levers 415 in articulated fashion by means of one rivet each.

In order that the stiles 404 of the rear shorter leg 402 do not have to have a slot guide extending in their longitudinal direction and therefore a simple profile shape can be used for these stiles, each of the two swing levers 415, which as in the second embodiment are developed. as double-armed levers the two arms 415' and 415" of which form a downwardly open obtuse angle, are pivotally connected at the end of the end facing the leg 402 to the one end of an intermediate lever 426 whose other end is pivoted to the inside of the adjacent stile 404. This pivot position is so selected that the arm 415" and the intermediate lever 426 form an obtuse angle open towards the top when the two legs 401 and 402 are spread to the maximum angle. A collapsing of the ladder then namely has the result that the swing levers 415 are swung in clockwise direction, as seen in the direction of view of FIG. 12, as is also true of the swing levers 315 of the first embodiment. The treads 406 which, differing from the embodiment shown in FIGS. 9 to 11, have a height which decreases towards their front edge then also swing into the position shown in FIG. 10 for the second embodiment and therefore do not project beyond the rear stiles 404 and the link members 411.

Figure 13:
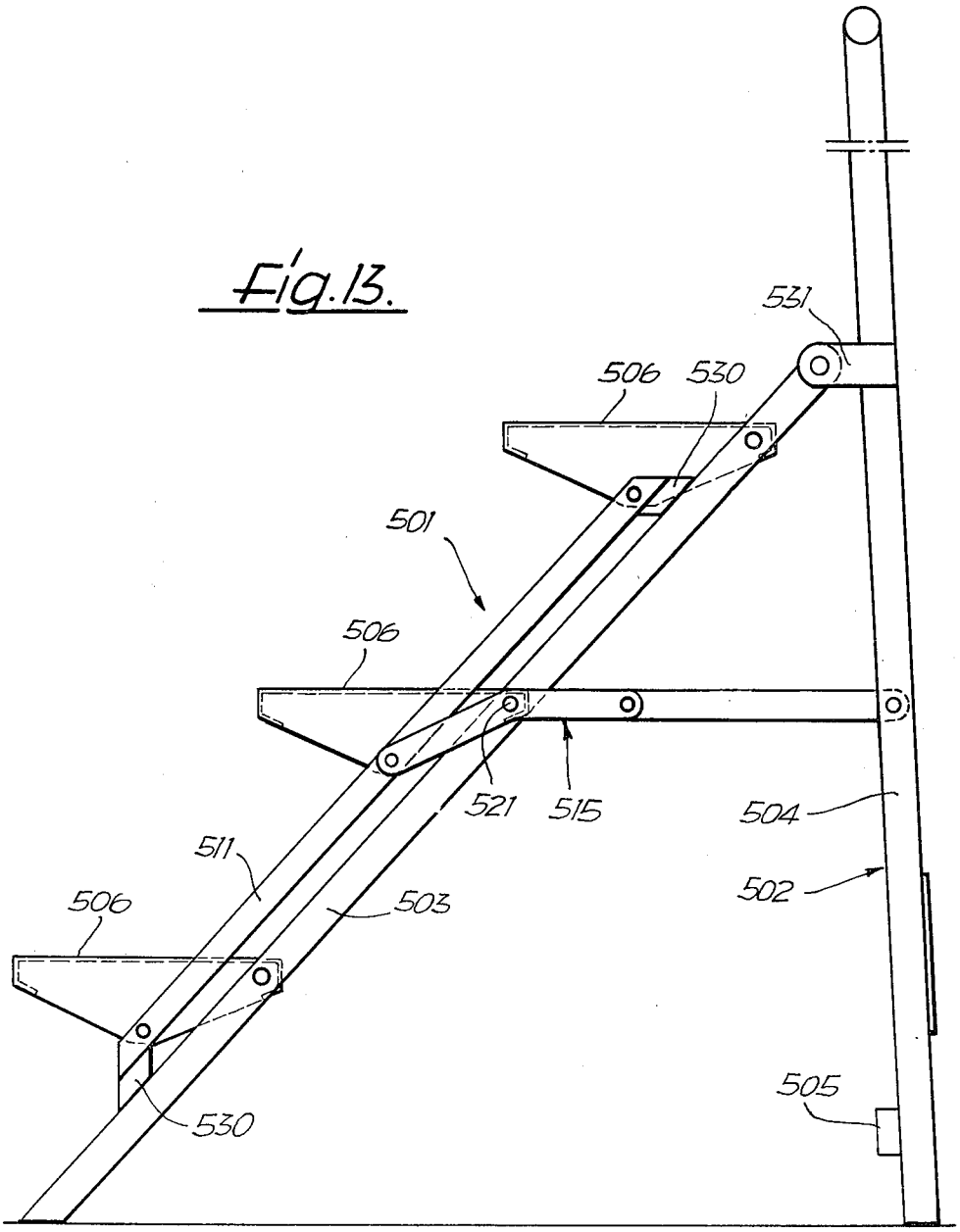
FIG. 13 is a side view of a fourth embodiment, shown in position of use.

A fourth embodiment of the stepladder of the invention is shown in FIG. 13. This embodiment differs from the embodiments already described on the one hand by the fact that the stiles 504 which form the rear leg 502 are extended beyond the place of connection to the stiles 503 of the front leg 501. These extensions form a handle to which the user of the ladder can hold fast. The upper end of the extensions is therefore connected by a transverse member. Of course, however, a tray could also be fastened to the extensions, as shown in the embodiment of FIGS. 7 and 8.

The other essential difference from the embodiments described above is that the design is so selected that the legs of the ladder can be spread or collapsed without the danger of the fingers of the user being pinched between two parts which move relatively to each other and in particular between the stiles of the rear and front legs or between the stiles of the front leg and the link members. At the upper and lower ends of the link members 511 which are arranged in front of the side facing away from the rear leg 502 of the stiles 503 bearing the treads 506 there are therefore provided spacers 530 which, as shown in FIG. 13, hold the link members 511 at a sufficient distance above the stiles 503 upon the maximum spread of the legs. Due to the support via the spacers 530, which are plastic parts which are inserted partially into the upper and lower ends of the link member and thereby connected with the latter, the front leg 501 of the stepladder also experiences an increase in stiffness and steadiness by the link members 511 in the position of use.

The development of the treads, their connection to the stiles 503 and to the link members 511 as well as the position of inclination of the front leg 501 upon maximum spread and the difference in height between two successive treads as well as the depth or stepping width of the treads is selected in the same manner as in the case of the embodiments which have been previously described so that reference is had to the statements made with respect to said embodiments. In principle, in the same way as in the embodiment of FIG. 12, the connection of the two legs 501 and 502 is effected by means of separate swing levers 515 on each side of the ladder. The two identically shaped swing levers 515 are double-armed levers which are swingably mounted on one of the shafts 521 which connect the treads 506 in swingable manner to the stiles 503. The one arm of the swing lever 515 extends from this pivot point to the point of articulation which connects the corresponding tread in articulated fashion to the link member 511. The other arm, in order not to require a slot-pin guide, is divided into two sections which are articulated to each other and the end thereof which lies furthest away is pivoted to the stile 504 of the rear leg 502. However, it would of course also be possible for this arm to be rigid and for a pin which engages into a guide groove of the stile 504 to be provided on its remote end.

In order to avoid the danger of pinching one's fingers upon the collapsing of the two legs, the upper end of each of the two stiles of the front leg 501 is pivoted to a connecting strap 531 which is fastened to the associated stile 504 of the rear leg and extends so far forward from the latter that when the two legs are parallel there is a distance between their stiles 503 and 504 respectively which excludes the danger of pinching. This distance is maintained in the region of the upper end of the two legs by a cross member 505 which protrudes beyond the side facing the front leg of the stiles 504 of the rear leg to a corresponding extent and serves as stop for the stiles 503 of the front leg. The cross member also stiffens the rear leg 502.

I claim:

1. In a stepladder, with two legs which are connected with each other swingably around an axis in the region of an upper end of the legs, at least one of the legs has transverse support members which are supported by a first pair of stiles, and arranged spaced apart from each other in the longitudinal direction of the first pair of stiles to form the treads, said transverse support members being developed as board-shaped treads which, when the legs are spread apart a predetermined maximum distance, the standing surface of the transverse support members is horizontal and lies in horizontal planes, the treads being connected swingably about axes parallel to each other, to the first pair of stiles and to respective link members which are parallel to the first pair of stiles, the improvement comprising a mutual supporting relationship between the first pair of stiles and the link members upon a predetermined maximum spread of the legs so as to increase the resistance to bending of the first pair of stiles and limit the swingability of the treads around their axis in a first direction of swing, the treads projecting beyond one side edge of the first pair of stiles facing away from the other leg such that stepping upon the treads causes a moment of rotation in a second direction which brings the link members towards the first pair of stiles, and the depth of the treads and the difference in height between two successive treads is within a predetermined dimensional range customary for stairs, the respective link members are associated with respective stiles of said first pair and the other said leg comprises a second pair of stiles, a double-armed swing lever being supported for swinging on at least one of the two stiles of the first pair for movement about an axis parallel to the axis of swing of the legs, one arm of said swing lever being pivoted to the link member associated with said one stile of said first pair and the other arm of said swing lever being connected to a corresponding stile of said other leg, the swing leverl includes a driver and the other leg includes a slot guide engaged by said driver.

2. The ladder according to claim 1, wherein the swing lever includes first and second levers pivotally connected to each other, one end of said second lever being pivoted to said corresponding stile of the other leg.

3. The ladder according to claim 1, wherein the swing lever is supported on a swing shaft which connects the treads to the respective stiles of said first pair and an arm of the swing lever pivoted to the link member is swingably connected to the link member by means of the shaft which connects said tread to the link member.

4. The ladder according to claim 3, wherein at least one of the two connections of the swing lever to the link member and one of the stiles of said first pair has an adjustable moment of friction.

5. The ladder according to claim 1, wherein the link members are arranged in front of the front side of the stiles which faces away from the other leg.

6. The ladder according to claim 1, wherein with said maximum spread of the two legs the link members rest against the first pair of stiles.

7. The ladder according to claim 1, wherein with the maximum spread of the two legs the link members are supported via stationary spacers on the first pair of stiles.

8. The ladder according to claim 1, wherein the link members terminate a predetermined distance from the lower end of the first pair of stiles.

9. The ladder according to claim 8, wherein the link members terminate at the lowermost tread.

10. The ladder according to claim 1, wherein the projection of the treads beyond the first side of the first pair of stiles increases from the uppermost tread to the lowermost tread.

11. The ladder according to claim 1, wherein the projection of at least the lowermost tread beyond the front side of the first pair of stiles is at least equal to half the depth of the tread.

12. The ladder according to claim 1, wherein with maximum spread of the legs the first pair of stiles and the link members extend at most up to the tread surface of the uppermost tread.

13. The ladder according to claim 1, wherein each of the stiles of one of the two legs has an extension which extends beyond the first tread.

14. The ladder according to claim 13, wherein the extension is integral with the stiles of said one of the two legs.

15. The ladder according to claim 1, wherein each of the link members is connected via a slot-pin guide with a separate of the second pair of stiles.

* * * * *